US009113252B2

(12) United States Patent
Liu

(10) Patent No.: US 9,113,252 B2
(45) Date of Patent: Aug. 18, 2015

(54) WATERPROOF EAR-JACK CONNECTOR

(71) Applicant: Huawei Device Co., Ltd., Shenzhen, Guangdong (CN)

(72) Inventor: Xuelong Liu, Shanghai (CN)

(73) Assignee: Huawei Device Co., Ltd., Shenzhen (CN)

( * ) Notice: Subject to any disclaimer, the term of this patent is extended or adjusted under 35 U.S.C. 154(b) by 0 days.

(21) Appl. No.: 14/100,862

(22) Filed: Dec. 9, 2013

(65) Prior Publication Data

US 2014/0093116 A1 Apr. 3, 2014

Related U.S. Application Data

(63) Continuation of application No. PCT/CN2011/083868, filed on Dec. 13, 2011.

(51) Int. Cl.

| | |
|---|---|
| ***H04R 1/10*** | (2006.01) |
| ***H01R 24/58*** | (2011.01) |
| ***H01R 13/52*** | (2006.01) |

(52) U.S. Cl.

CPC ..... *H04R 1/10* (2013.01); *H01R 13/521* (2013.01); *H01R 24/58* (2013.01)

(58) Field of Classification Search

CPC .... H04R 1/10; H04R 2205/022; H04R 1/105; H04R 5/0335; H04R 2201/10

USPC ..... 381/370, 374, 384

See application file for complete search history.

(56) References Cited

U.S. PATENT DOCUMENTS

| | | | | |
|---|---|---|---|---|
| 5,092,795 | A | 3/1992 | Kitagawa | |
| 5,277,628 | A | 1/1994 | Lin et al. | |
| 5,718,605 | A | 2/1998 | Morikawa et al. | |
| 7,749,002 | B1 | 7/2010 | Chiang | |
| 8,123,569 | B2 | 2/2012 | Little et al. | |
| 8,237,623 | B2 * | 8/2012 | Hung | 381/384 |
| 8,308,511 | B2 | 11/2012 | Zhang | |
| 2006/0083399 | A1 * | 4/2006 | Yang | 381/384 |
| 2007/0127764 | A1 * | 6/2007 | Yang | 381/384 |
| 2010/0035474 | A1 | 2/2010 | Xu et al. | |

FOREIGN PATENT DOCUMENTS

| | | | |
|---|---|---|---|
| CN | 2373918 | Y | 4/2000 |
| CN | 201450169 | U | 5/2010 |
| CN | 201450198 | U | 5/2010 |
| CN | 201556771 | U | 8/2010 |

(Continued)

*Primary Examiner* — Suhan Ni

(74) *Attorney, Agent, or Firm* — Leydig, Voit & Mayer, Ltd.

(57) ABSTRACT

A waterproof ear-jack connector includes: an ear-jack connector housing, a contact terminal, and a baffle. The ear-jack connector housing is disposed with a space running through the ear-jack connector housing, the space is used for accommodating an earphone plug; the baffle is located at a tail opening of the ear-jack connector housing, and tightly contacts the tail opening of the ear-jack connector housing, so as to seal the tail opening of the ear-jack connector housing; the contact terminal tightly presses against an inner wall of the space, and passes through from a hole disposed on the baffle; and the shape of the hole matches a cross section of the contact terminal, so that the hole is plugged by the contact terminal. The ear-jack connector itself is equipped with a waterproof function, thereby facilitating the thinning of an electronic product.

20 Claims, 2 Drawing Sheets

(56) References Cited

FOREIGN PATENT DOCUMENTS

| | | | |
|---|---|---|---|
| CN | 102774062 | U | 3/2011 |
| CN | 201781114 | U | 3/2011 |
| CN | 201797146 | U | 4/2011 |
| CN | 102148458 | A | 8/2011 |
| CN | 102270792 | A | 12/2011 |
| JP | 06023176 | U | 3/1994 |
| JP | 2000164282 | A | 6/2000 |
| JP | 2009516901 | A | 4/2009 |
| JP | 2009252704 | A | 10/2009 |
| JP | 2010003442 | A | 1/2010 |
| JP | 2010182602 | A | 8/2010 |

* cited by examiner

WATERPROOF EAR-JACK CONNECTOR

CROSS-REFERENCE TO RELATED APPLICATIONS

This application is a continuation of International Patent Application No. PCT/CN2011/083868, filed on Dec. 13, 2011, which is hereby incorporated by reference in its entirety.

TECHNICAL FIELD

The present invention relates to the field of electronic products, and in particular, to a waterproof ear-jack connector.

BACKGROUND

Ear-jack connectors of electronic products are being continuously developed to adapt to the electronic products designed to be lighter, thinner and equipped with more functions. Currently, many electronic products, such as mobile phones, mobile Internet devices (MID), palmtop computers, MP3s, and MP4s, are waterproof, but ear-jack connectors themselves are not waterproof.

A contact terminal of an existing ear-jack connector usually stretches out from a plastic hole at a bottom surface or a side of the ear-jack connector, and contacts a signal terminal of a circuit board. Therefore, if there is water flowing through an earphone jack of the ear-jack connector, the water may flow into the circuit board inside the electronic product along the plastic hole at the bottom surface or the side of the ear-jack connector which might cause damage to the electronic device. In order to implement waterproofing of the ear-jack connector, a protection stopper or a structural piece is generally added into the ear-jack connector to block the water to prevent the water from entering the electronic product through the plastic hole at the bottom surface or the side of the ear-jack connector.

In practice, a protection stopper or a structural piece in an ear-jack connector is used for waterproofing, which usually causes the size of the ear-jack connector being increased. Thus, existing protection stoppers or the structural pieces in ear-jack connectors are unfavorable to the electronic products which are designed to have smaller sizes.

SUMMARY

In the light of the foregoing, an embodiment of the present invention provides a waterproof ear-jack connector, and the ear-jack connector itself is equipped with a waterproof function.

A waterproof ear-jack connector includes:

an ear-jack connector housing, a contact terminal, and a baffle, where the ear-jack connector housing is disposed with a space running through the ear-jack connector housing, and the space is used for accommodating an earphone plug;

the baffle is located at a tail opening of the ear-jack connector housing, and tightly contacts the tail opening of the ear-jack connector housing, so as to seal the tail opening of the ear-jack connector housing; and the contact terminal tightly presses against an inner wall of the space, and passes through from a hole disposed on the baffle; and the shape of the hole matches a cross section of the contact terminal, so that the hole is plugged by the contact terminal.

In one embodiment of the present invention, an ear-jack connector housing of a waterproof ear-jack connector is disposed with a space running through the ear-jack connector housing, where the space is used for accommodating an earphone plug; and meanwhile a baffle located at a tail opening of the ear-jack connector housing tightly contacts the tail opening of the ear-jack connector housing, so as to seal the tail opening of the ear-jack connector housing, and a contact terminal that tightly presses against an inner wall of the space and passes through from a hole on the baffle plugs the hole, so that the waterproof ear-jack connector itself may implement a waterproof function. No protection stopper or structural piece needs to be added into the waterproof ear-jack connector provided in the embodiment of the present invention to perform water blocking, thereby avoiding increase of the size of an ear-jack connector, and facilitating the thinning of an electronic product.

BRIEF DESCRIPTION OF DRAWINGS

To describe the technical solutions in the embodiments of the present invention more clearly, the accompanying drawings required for describing the embodiments are introduced briefly in the following. The accompanying drawings and the following description show only some embodiments of the invention, and persons of ordinary skill in the art may also derive other drawings from these accompanying drawings without creative efforts.

DESCRIPTION OF EMBODIMENTS

The technical solutions in the embodiments of the present invention are clearly and described in the following with reference to the accompanying drawings in the embodiments of the present invention. Apparently, the embodiments to be described are only a part rather than all of the embodiments of the present invention. All other embodiments obtained by persons of ordinary skill in the art based on the embodiments of the present invention without creative efforts shall fall within the protection scope of the present invention.

An embodiment of the present invention provides a waterproof ear-jack connector, and the ear-jack connector itself is equipped with a waterproof function, which facilitates the thinning of an electronic product. The description is made in the following through a specific embodiment.

Figure 1:
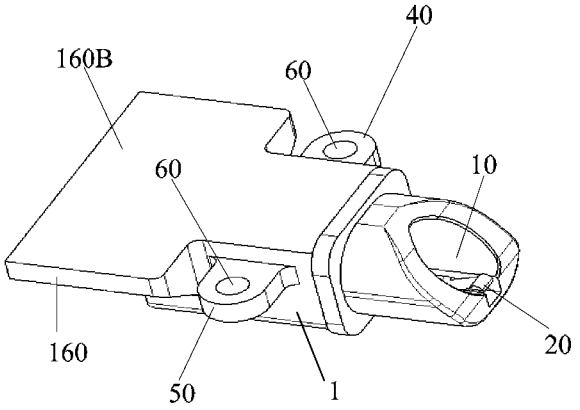
FIG. 1 is a side view of a waterproof ear-jack connector provided in an embodiment of the present invention.
Figure 2:
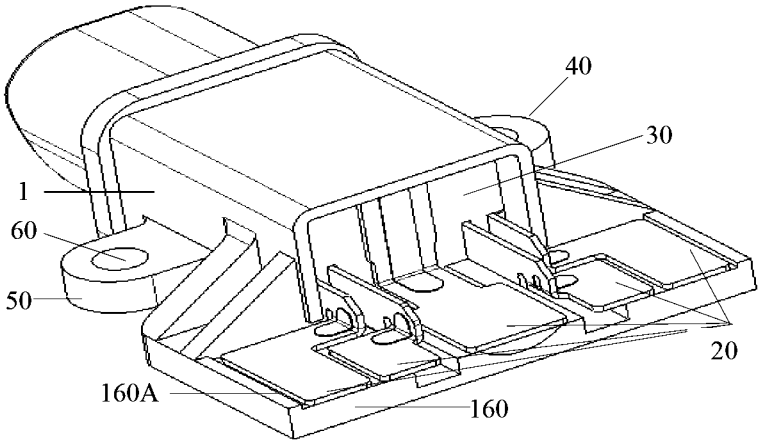
FIG. 2 is a another side view of the waterproof ear-jack connector shown in FIG. 1.

Referring to FIG. 1 to FIG. 2, FIG. 1 is a side view of a waterproof ear-jack connector according to an embodiment of the present invention, and FIG. 2 is an another side view of the waterproof ear-jack connector shown in FIG. 1. The waterproof ear-jack connector provided in the embodiment of the present invention may include:

an ear-jack connector housing 1, a contact terminal 20, and a baffle 30.

The ear-jack connector housing 1 is disposed with a space (10) running through the ear-jack connector housing 1, and the space 10 is used for accommodating an earphone plug.

The baffle 30 is located at a tail opening of the ear-jack connector housing 1, and tightly contacts the tail opening of the ear-jack connector housing 1, so as to seal the tail opening of the ear-jack connector housing 1.

The contact terminal 20 tightly presses against an inner wall of the space 10, and passes through from a hole disposed on the baffle 30; and the shape of the hole matches a cross section of the contact terminal 20, so that the hole is plugged by the contact terminal 20.

In the embodiment of the present invention, that the baffle 30 tightly contacts the tail opening of the ear-jack connector housing 1 specifically means that the shape of the baffle 30 matches the shape of the tail opening of the ear-jack connector housing 1, and in a state that the baffle 30 is located at the tail opening of the ear-jack connector housing 1, the baffle 30 may seal the tail opening of the ear-jack connector housing 1, so that at the tail of the ear-jack connector housing 1, a waterproof function is implemented. That is to say, water cannot enter a circuit board inside an electronic product through the tail of the ear-jack connector housing 1.

In the embodiment of the present invention, that the hole is plugged by the contact terminal 20 means that the hole is completely sealed by the cross section of the contact terminal 20, and no gap exists between the hole and the cross section of the contact terminal 20.

In the embodiment of the present invention, the ear-jack connector housing 1 of the waterproof ear-jack connector is disposed with the space 10 running through the ear-jack connector housing 1, where the space 10 is used for accommodating an earphone plug; and meanwhile the baffle 30 located at the tail opening of the ear-jack connector housing 1 tightly contacts the tail opening of the ear-jack connector housing 1, so as to seal the tail opening of the ear-jack connector housing 1, and the contact terminal 20 that tightly presses against the inner wall of the space 10 and passes through from the hole on the baffle 30 plugs the hole, so that the waterproof ear-jack connector itself may implement a waterproof function. No protection stopper or structural piece needs to be added into the waterproof ear-jack connector provided in the embodiment of the present invention to perform water blocking, and an ultrathin design concept is obeyed, thereby avoiding increase of the size of an ear-jack connector, and facilitating the thinning of an electronic product.

As an optional implementation manner, in the waterproof ear-jack connector provided in the embodiment of the present invention, the ear-jack connector housing 1 may be disposed with at least one fixing piece, and the fixing piece is used for fixing the ear-jack connector housing 1 and a casing of an electronic product, so as to improve mounting stability of the ear-jack connector housing 1.

For example, as shown in FIG. 1 to FIG. 2, in the waterproof ear-jack connector provided in the embodiment of the present invention, a middle part of the ear-jack connector housing 1 may be disposed with a left fixing piece 40 and a right fixing piece 50. Further, the left fixing piece 40 and the right fixing piece 50 are symmetrical, and the left fixing piece 40 and the right fixing piece 50 are each disposed with a screw hole 60.

Through the screw hole 60 on the left fixing piece 40 and the screw hole 60 on the right fixing piece 50, the ear-jack connector housing 1 and the casing of the electronic product may be locked together by using screws, so as to improve mounting stability of the ear-jack connector housing 1.

As an optional implementation manner, in order to cooperate with some special structure arrangements of the casing, the left fixing piece 40 and the right fixing piece 50 may also be disposed at other positions close to the tail of the ear-jack connector housing 1 or the head of the ear-jack connector housing 1, which is not limited in the embodiment of the present invention.

As an optional implementation manner, in order to cooperate with some special structure arrangements of the casing, the ear-jack connector housing 1 may be disposed with only the left fixing piece 40 or the right fixing piece 50, as long as the left fixing piece 40 or the right fixing piece 50 can fix the ear-jack connector housing 1 and the casing of the electronic product, which is not limited in the embodiment of the present invention.

As an optional implementation manner, in order to cooperate with some special structure arrangements of the casing, the ear-jack connector housing 1 may be disposed with at least two left fixing pieces 40 and at least two right fixing pieces 50, so as to better fix the ear-jack connector housing 1 and the casing of the electronic product, which is not limited in the embodiment of the present invention.

As an optional implementation manner, in order to cooperate with some special structure arrangements of the casing, the left fixing piece 40 and the right fixing piece 50 may be disposed with a plurality of screw holes 60, so as to better fix the ear-jack connector housing 1 and the casing of the electronic product, which is not limited in the embodiment of the present invention.

As an optional implementation manner, if a tiny gap exists between the baffle 30 located at the tail opening of the ear-jack connector housing 1 and the tail opening of the ear-jack connector housing 1, the gap may be sealed by using a waterproof adhesive, so that even if water flows into the space 10, the water still cannot enter the circuit board inside the electronic product through the tail of the ear-jack connector housing 1. Similarly, if a tiny gap exists between the contact terminal 20 and the hole on the baffle 30, the gap may also be sealed by using a waterproof adhesive, so that the entire tail of the ear-jack connector housing 1 is a fully-sealed structure.

As shown in FIG. 1 or FIG. 2, the tail of the ear-jack connector housing 1 is disposed with a contact plate 160. As an optional implementation manner, a part of the contact terminal 20, which passes through from the hole on the baffle 30, may tightly press against a lower surface 160A of the contact plate 160 disposed at the tail of the ear-jack connector housing 1; and the lower surface 160A is a surface located at the same side where the tail opening of the ear-jack connector housing 1 is located. Further, in this implementation manner, an upper surface 160B of the contact plate 160 disposed at the tail of the ear-jack connector housing 1 and an upper surface of the tail of the ear-jack connector housing 1 may be located on the same horizontal plane, and the upper surface 160B of the contact plate 160 is a surface that is opposite to the lower surface 160A. By using this implementation manner, the thinning of an electronic product mounted with a waterproof ear-jack connector is facilitated. When the upper surface of the contact plate 160 and an upper surface of the ear-jack connector housing 1 are located on the same horizontal plane, a total thickness after contact mounting of the waterproof ear-jack connector and the circuit board may be minimized, thereby facilitating the thinning of the electronic product mounted with the waterproof ear-jack connector.

Figure 3:
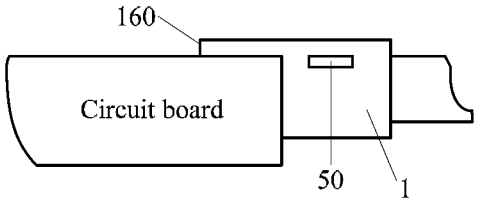
FIG. 3 is a schematic diagram of contact mounting of the waterproof ear-jack connector shown in FIG. 1 and a circuit board.

Referring to FIG. 3, FIG. 3 is a schematic diagram of contact mounting of the waterproof ear-jack connector shown in FIG. 1 and a circuit board inside an electronic product. As shown in FIG. 3, the upper surface 160B of the contact plate 160 of the waterproof ear-jack connector and the upper surface of the tail of the ear-jack connector housing 1 are located on the same horizontal plane; after contact mounting of the waterproof ear-jack connector and the circuit board, the contact terminal 20 that tightly presses against the lower surface 160A of the contact plate 160 of the waterproof ear-jack connector is connected to a signal terminal of the circuit board, and an overlapping thickness of the ear-jack connector housing 1 of the waterproof ear-jack connector and the circuit board is maximum, where the ear-jack connector housing 1 of the waterproof ear-jack connector is located at a side of the circuit board, so that after contact mounting of the waterproof ear-jack connector and the circuit board, the total thickness of the circuit board and the waterproof ear-jack connector is minimum, thereby facilitating the thinning of the electronic product mounted with the waterproof ear-jack connector.

For example, when the upper surface 160B of the contact plate 160 is lower than the upper surface of the tail of the ear-jack connector housing 1, after contact mounting of the waterproof ear-jack connector and the circuit board, an overlapping thickness of the waterproof ear-jack connector and the circuit board is relatively small, so that the total thickness after contact mounting of the waterproof ear-jack connector and the circuit board is relatively large, which is unfavorable to the thinning of the electronic product mounted with the waterproof ear-jack connector.

It can be seen that, under a situation without considering further thinning of the electronic product, the upper surface 160B of the contact plate 160 disposed at the tail of the ear-jack connector housing 1 may also be lower than the upper surface of the tail of the ear-jack connector housing 1, which is not limited in the embodiment of the present invention. In this manner, the waterproof ear-jack connector itself may still implement a waterproof function, and no protection stopper or structural piece needs to be added into the waterproof ear-jack connector to perform water blocking.

In the waterproof ear-jack connector provided in the embodiment of the present invention, the contact terminal 20 may include a microphone terminal, a grounding terminal, a right sound channel terminal, a left sound channel terminal, and a switch terminal. The microphone terminal is generally arranged at a bottom wall of an earphone jack, and the grounding terminal, the right sound channel terminal, the left sound channel terminal, and the switch terminal are generally arranged at a side wall of the earphone jack. In a practical application, a distance between the microphone terminal and an opening edge of the earphone jack is minimum, and a visible contact terminal in FIG. 1 is the microphone terminal, where a distance between the grounding terminal and the opening edge of the earphone jack is slightly greater than the distance between the microphone terminal and the opening edge of the earphone jack; a distance between the right sound channel terminal and the opening edge of the earphone jack is slightly greater than the distance between the grounding terminal and the opening edge of the earphone jack; a distance between the left sound channel terminal and the opening edge of the earphone jack is slightly greater than the distance between the right sound channel terminal and the opening edge of the earphone jack; and a distance between the switch terminal and the opening edge of the earphone jack is slightly greater than the distance between the left sound channel terminal and the opening edge of the earphone jack.

As an optional implementation manner, parts of the microphone terminal, the grounding terminal, the right sound channel terminal, the left sound channel terminal, and the switch terminal, which pass through from the hole on the baffle 30, may be aligned into one row, as shown in FIG. 2. Namely, the parts of the microphone terminal, the grounding terminal, the right sound channel terminal, the left sound channel terminal, and the switch terminal, which pass through from the hole on the baffle 30, may be aligned into one row and tightly press against the lower surface 160A of the contact plate 160 disposed at the tail of the ear-jack connector housing 1.

Figure 4:
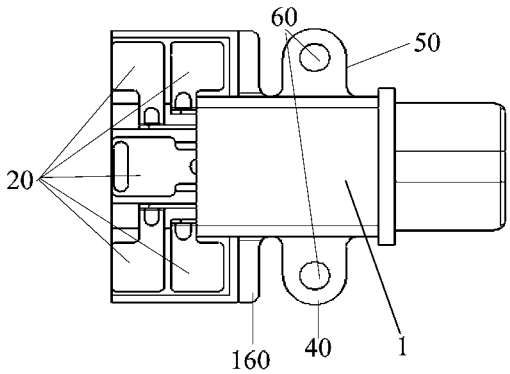
FIG. 4 is another top view of the waterproof ear-jack connector shown in FIG. 1.

As an optional implementation manner, parts of the microphone terminal, the grounding terminal, the right sound channel terminal, the left sound channel terminal, and the switch terminal, which pass through from the hole on the baffle 30, may also be aligned into at least two rows, as shown in FIG. 4. FIG. 4 is another top view of the waterproof ear-jack connector shown in FIG. 1. Namely, the parts of the microphone terminal, the grounding terminal, the right sound channel terminal, the left sound channel terminal, and the switch terminal, which pass through from the hole on the baffle 30, may be aligned into at least two rows and tightly press against the lower surface 160A of the contact plate 160 disposed at the tail of the ear-jack connector housing 1.

As an optional implementation manner, parts of the microphone terminal, the grounding terminal, the right sound channel terminal, the left sound channel terminal, and the switch terminal, which pass through from the hole on the baffle 30, may also be arranged in another manner and tightly press against the lower surface 160A of the contact plate 160 disposed at the tail of the ear-jack connector housing 1, which is not limited in the embodiment of the present invention.

As an optional implementation manner, parts of the microphone terminal, the grounding terminal, the right sound channel terminal, the left sound channel terminal, and the switch terminal, which pass through from the hole on the baffle 30, may be connected to the signal terminal of the circuit board in a welding manner or an elastic connection manner.

As shown in FIG. 1, an opening of the space 10 that is used for accommodating an earphone plug is located on a cross section of the head of the ear-jack connector housing 1. As an optional implementation manner, the cross section of the head of the ear-jack connector housing 1 may be a horizontal end face or an arc-shaped end face, which is not limited in the embodiment of the present invention. Particularly, when the cross section of the head of the ear-jack connector housing 1 is an arc-shaped end face, the cross section of the head of the ear-jack connector housing 1 can better match an outline of the casing, so that an arc-shaped application may be implemented for the outline of the casing, thereby further improving aesthetic feeling of the outline of the casing.

In the waterproof ear-jack connector provided in the embodiment of the present invention, the diameter of the earphone plug may be 2.5 mm or 3.5 mm, which is not limited in the embodiment of the present invention. The waterproof ear-jack connector provided in the embodiment of the present invention is applicable to a mobile phone, a computer, an MID, a palmtop computer, an MP3, an MP4, and other electronic products in which an ear-jack connector needs to be mounted.

As an optional implementation manner, the ear-jack connector housing 1 may be formed by pressing a plastic material, so that the ear-jack connector housing 1 may be prevented from being corroded by water or other liquid.

In conclusion, the waterproof ear-jack connector itself provided in the embodiment of the present invention may implement a waterproof function, and no protection stopper or structural piece needs to be added into the waterproof ear-jack connector to perform water blocking, thereby avoiding increase of the size of an ear-jack connector, and facilitating the thinning of an electronic product.

The waterproof ear-jack connector provided in the present invention is introduced in detail in the foregoing. Persons of ordinary skill in the art may make variations to the specific implementation manner and application scope according to the ideas of the embodiments of the present invention. In conclusion, content of the specification shall not be construed as a limitation to the present invention.

What is claimed is:

1. A waterproof ear-jack connector, comprising:

an ear-jack connector housing, a contact terminal, a baffle, and a contact plate, wherein:

the ear-jack connector housing is disposed with a space through the ear-jack connector housing, and the space is used for accommodating an earphone plug;

the baffle is located at a tail opening of the ear-jack connector housing, and tightly contacts the tail opening of the ear-jack connector housing, so as to seal the tail opening of the ear-jack connector housing;

the contact terminal tightly presses against an inner wall of the space, and passes through from a hole disposed on the baffle; and the shape of the hole matches a cross section of the contact terminal, so that the hole is plugged by the contact terminal; and the contact plate is disposed at the tail of the ear-jack connector housing; and a part of the contact terminal, which passes through from the hole disposed on the baffle, tightly presses against a lower surface of the contact plate; and the lower surface of the contact plate is a surface located at the same side where the tail opening of the ear-jack connector housing is located.

2. The waterproof ear-jack connector according to claim 1, wherein:

the ear-jack connector housing is disposed with at least one fixing piece.

3. The waterproof ear-jack connector according to claim 2, wherein:

the fixing piece is disposed with a screw hole.

4. The waterproof ear-jack connector according to claim 1, wherein an upper surface of the contact plate and an upper surface of the tail of the ear-jack connector housing are located on the same horizontal plane, and the upper surface of the contact plate is a surface that is opposite to the lower surface of the contact plate.

5. The waterproof ear-jack connector according to claim 1, wherein the contact terminal comprises a microphone terminal, a grounding terminal, a right sound channel terminal, a left sound channel terminal, and a switch terminal, wherein parts of the microphone terminal, the grounding terminal, the right sound channel terminal, the left sound channel terminal, and the switch terminal, which pass through from the hole, are aligned into one row.

6. The waterproof ear-jack connector according to claim 1, wherein the contact terminal comprises a microphone terminal, a grounding terminal, a right sound channel terminal, a left sound channel terminal, and a switch terminal, wherein parts of the microphone terminal, the grounding terminal, the right sound channel terminal, the left sound channel terminal, and the switch terminal, which pass through from the hole, are aligned into at least two rows.

7. The waterproof ear-jack connector according to claim 1, wherein an opening of the space is located on a cross section of a head of the ear-jack connector housing, and the cross section of the head of the ear-jack connector housing is a horizontal end face or an arc-shaped end face.

8. The waterproof ear-jack connector according to claim 1, wherein the diameter of the earphone plug is 2.5 mm or 3.5 mm.

9. The waterproof ear-jack connector according to claim 1, wherein the ear-jack connector housing is formed by pressing a plastic material.

10. A electronic device with an ear-jack connector, wherein the ear-jack connector comprises:

an ear-jack connector housing, a contact terminal, a baffle, and a contact plate, wherein the ear-jack connector housing is disposed with a space through the ear-jack connector housing, and the space is used for accommodating an earphone plug;

wherein the baffle is located at a tail opening of the ear-jack connector housing, and tightly contacts the tail opening of the ear-jack connector housing, so as to seal the tail opening of the ear-jack connector housing;

wherein the contact terminal tightly presses against an inner wall of the space, and passes through from a hole disposed on the baffle; and the shape of the hole matches a cross section of the contact terminal, so that the hole is plugged by the contact terminal; and wherein the contact plate is disposed at the tail of the ear-jack connector housing; and a part of the contact terminal, which passes through from the hole disposed on the baffle, tightly presses against a lower surface of the contact plate; and the lower surface of the contact plate is a surface located at the same side where the tail opening of the ear-jack connector housing is located.

11. The electronic device according to claim 10, wherein:

the ear-jack connector housing is disposed with at least one fixing piece.

12. The electronic device according to claim 11, wherein:

the fixing piece is disposed with a screw hole.

13. The electronic device according to claim 10, wherein an upper surface of the contact plate and an upper surface of the tail of the ear-jack connector housing are located on the same horizontal plane, and the upper surface of the contact plate is a surface that is opposite to the lower surface of the contact plate.

14. The electronic device according to claim 10, wherein the contact terminal comprises a microphone terminal, a grounding terminal, a right sound channel terminal, a left sound channel terminal, and a switch terminal, wherein parts of the microphone terminal, the grounding terminal, the right sound channel terminal, the left sound channel terminal, and the switch terminal, which pass through from the hole, are aligned into one row.

15. The electronic device according to claim 10, wherein the contact terminal comprises a microphone terminal, a grounding terminal, a right sound channel terminal, a left sound channel terminal, and a switch terminal, wherein parts of the microphone terminal, the grounding terminal, the right sound channel terminal, the left sound channel terminal, and the switch terminal, which pass through from the hole, are aligned into at least two rows.

16. The electronic device according to claim 10, wherein an opening of the space is located on a cross section of a head of the ear-jack connector housing, and the cross section of the head of the ear-jack connector housing is a horizontal end face or an arc-shaped end face.

17. The electronic device according to claim 10, wherein the diameter of the earphone plug is 2.5 mm or 3.5 mm.

18. The electronic device according to claim 10, wherein the ear-jack connector housing is formed by pressing a plastic material.

19. The electronic device according to claim 10, wherein the electronic device comprises a circuit board;

the part of the contact terminal, which passes through from the hole disposed on the baffle, is connected to a signal terminal of the circuit board in a welding manner.

20. The electronic device according to claim 10, wherein the electronic device comprises a circuit board;

the part of the contact terminal, which passes through from the hole disposed on the baffle, is connected to a signal terminal of the circuit board in an elastic connection manner.

* * * * *